United States Patent [19]

Clay

[11] 4,005,526

[45] Feb. 1, 1977

[54] VACUUM HAIR CUTTER

[76] Inventor: Scott Douglas Clay, P.O. Box 326, Monticello, Miss. 39654

[22] Filed: Aug. 27, 1975

[21] Appl. No.: 608,100

[52] U.S. Cl. ..... 30/133

[51] Int. Cl.[2] ..... B26B 19/44

[58] Field of Search ..... 30/133, 124

[56] References Cited

UNITED STATES PATENTS

| | | | |
|---|---|---|---|
| 3,353,265 | 11/1967 | Mendoza | 30/133 |
| 3,505,732 | 4/1970 | Trapani | 30/133 |
| 3,606,681 | 9/1971 | Rogers | 30/133 |

*Primary Examiner*—Al Lawrence Smith
*Assistant Examiner*—J. C. Peters

[57] ABSTRACT

A barbering implement for cutting hair off the head, the implement including a tube attached to a vacuum cleaner hose or other vacuum source, the tube having a ring integral with its side for receiving the fingers of a person's hand, and a lever pivotable at its center about a rivet secured to the outer side of the tube, other end of the lever having a thumb receiving opening, the other end of the lever carrying a replaceable safety razor blade for being moved across the end of the tube so to shear off hair as it is pulled by a vacuum into the tube, and an adjustable graduated rule being slidable forwardly adjacent to the tube opening for guiding a length of hair being retained upon the head.

2 Claims, 3 Drawing Figures

VACUUM HAIR CUTTER

This invention relates generally to hair cutting implements.

A principal object of the present invention is to provide a hair cutting implement that utilized the suction of a household vacuum cleaner or other vacuum source to hold hair straight out from the scalp or ear during the hair cutting operation, thereby eliminating the necessity of the barbers left hand and a comb to accomplish the same.

Still another object of the present invention is to provide a vacuum hair cutter in which the clipped off hair is thereafter into the vacuum cleaner or other vacuum source recepticle, thereby eliminating the mess of clipped off hair scattered about a floor.

Still another object of the present invention is to provide a vacuum hair cutter which includes a measuring rule for easily guiding a barber the length of hair that is to be retained upon the head.

Still another object of the present invention is to provide a vacuum hair cutter which can be readily operated by any person without particular skill.

Other objects are to provide a vacuum hair cutter which is simple in design, inexpensive to manufacture, rugged in construction, easy to use and efficient in operation.

These and other objects will be readily evident upon a study of the following specification and the accompanying drawing wherein.

Figure 1:
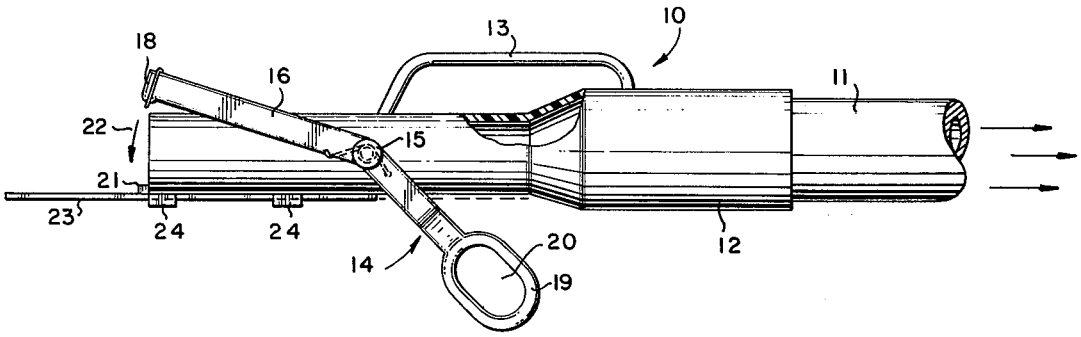
FIG. 1 is a side elevation view of the present invention, shown partly broken away to illustrate the interior structure.
Figure 2:
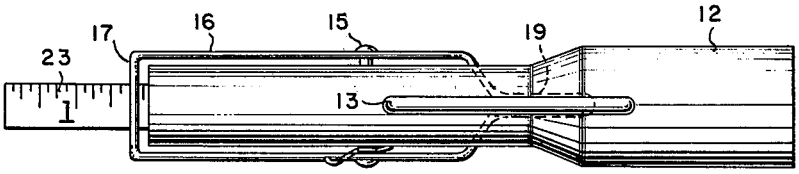
FIG. 2 is a top plan view of the device shown in FIG. 1, and shown removed from an end of a vacuum hose.
Figure 3:
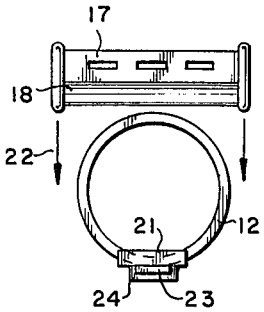
FIG. 3 is an enlarged front end view of the invention shown in elevation.

Referring now to the drawing in detail, the reference numeral 10 represents a vacuum hair cutter according to the present invention and which is attachable upon the end of a vacuum cleaner hose 11 connected to a conventional vacuum cleaner, not shown.

The vacuum hair cutter 10 includes a tube 12 made preferably of a soft, unbreakable polymeric plastic material, one end of the tube being of a diameter suitable for securement to the vacuum cleaner hose or other vacuum source, the opposite end of the tube being reduced in its diameter as shown. A configurated ring 13 is permenently affixed to an outer side of the tube for the purpose of receiving fingers of a person holding the same.

A lever 14 is pivotally attached to the tube 12 by means of rivet 15, the lever being of a generally frame like shape by including parallel opposite side legs 16 through a longitudinally intermediate portion of which the rivets 15 extend, the lever also including a transverse intermediate portion 17 integral with the front end of the legs 16, the portion 17 carrying a replaceable razor blade 18 which accordingly is removable across a front end of the tube 12. The opposite ends of the lever are brought together underneath the tube so to form a common handle 19 having an opening 20 therethrough for receiving a thumb of a person using the implement.

A stop 21 may be integrally formed extending forwardly of the front end of the tube in order to limit the pivotal travel of the lever 14 when pivotted into the direct on indicated by the arrow 22.

An adjustable graduated rule 23 is positioned adjacent and underside of the tube and is slidably held thereagainst by means of loops 24 formed integrally with the underside of the tube so that the graduated rule can be slided forwardly in order to measure a length of hair that it is to be retained upon the head. For the present invention is not limited to any specific dimensions, the graduated rule can be preferably made to extend at least two inches forwardly of the end of the tube for a most pratical applications.

In operative use, the implement is attached to the vacuum cleaner hose or other vacuum source, as shown in FIG. 1, and a person holds the implement with his one hand by the fingers being passed under the ring 13 while the thumb is passed through the handle opening 20. The implement is then operated in the manner of a scissors. The hair that is to be cut is pulled by the vacuum into the tube 12 so that the hair stands straight out from the scale or rule 23 may be positioned adjacent to the scalp while the reading upon the rule which is adjacent to the end of the tube will indicate the length of hair that will be retained after the cutting operation. By simply squeezing the handle of the lever towards the tube, the razor blade 18 moves across the end of the tube so to cut off the end of the hair which then is pulled by the vacuum through the tube 12 and into the hose 11 leading to refuge recepticle. Thus there is no mess of hair which is cut off falling upon a floor.

While various changes may be made in the detailed construction, it is understood that such changes will be within the spirit and scope of the present invention as is defined by the appended claims.

I claim

1. In a vacuum hair cutter, the combination of a scissors-like implement attachable to a hose of a vacuum cleaner or other vacuum source, said scissors-like implement comprising a tube and a frame-like lever pivotally attached together at their approximately longitudinal centers, and said lever carrying a replaceable safety razor blade movable transversely across a first end of said tube, for cutting hair that is vacuum pulled into said tube, said tube being made of a soft, unbreakable polymeric plastic material, and having a diametrical size at a second opposite end thereof, suitable for connection to said vacuum cleaner hose, said first end of said tube being of a smaller diameter than said second opposite end, a ring integral with an outer side of said tube being adaptable for receiving fingers of a person's hand operating said vacuum hair cutter, said lever comprising a pair of parallel, spaced-apart side legs positioned adjacent diametrically opposite sides of said tube, a forward end of said legs being interconnected by a transverse extending portion, said transverse extending portion carrying said replaceable safety razor blade, and opposite, rearward end of said legs each being sidewardly offset toward each other, forming a common handle having a thumb loop therethrough.

2. The combination as set forth in claim 1, wherein said handle of said lever and said ring of said tube are on diametrically opposite sides of said tube.

* * * * *